United States Patent [19]

Hirschbein

[11] 4,368,905

[45] Jan. 18, 1983

[54] EXIT DOOR LOCKING MECHANISM HAVING MULTIPLE BOLTS

[75] Inventor: Aaron M. Hirschbein, Diamond Bar, Calif.

[73] Assignee: Adams Rite Manufacturing Co., Glendale, Calif.

[21] Appl. No.: 170,405

[22] Filed: Jul. 21, 1980

[51] Int. Cl.[3] ..... E05C 9/04; E05C 9/12

[52] U.S. Cl. ..... 292/5; 292/22; 292/39; 292/340; 292/DIG. 60

[58] Field of Search ..... 292/5, 3, 21, 22, 26, 292/32, 36, 39, 48, 92, 340, 216, DIG. 53, DIG. 60, DIG. 65; 411/340; 403/353

[56] References Cited

U.S. PATENT DOCUMENTS

| | | | |
|---|---|---|---|
| 781,551 | 1/1905 | Quillin | 292/48 |
| 978,380 | 12/1910 | Kennedy | 411/340 |
| 1,346,487 | 7/1920 | Doyle | 403/353 X |
| 1,638,748 | 8/1927 | Santee | 292/48 X |
| 2,224,675 | 12/1940 | Graham | 292/48 X |
| 2,333,467 | 11/1943 | Claud-Mantle | 292/48 |
| 2,693,372 | 11/1954 | Ludwig et al. | 411/340 X |
| 3,127,807 | 4/1964 | Modrey | 411/340 |
| 3,244,056 | 4/1966 | Kern | 411/340 |
| 3,485,112 | 12/1969 | Goosmann | 403/353 X |
| 4,083,590 | 4/1978 | Folger | 292/21 X |
| 4,130,306 | 12/1978 | Brkic | 292/5 |
| 4,193,618 | 3/1980 | Lee et al. | 292/39 |

*Primary Examiner*—William E. Lyddane
*Attorney, Agent, or Firm*—Whann & McManigal

[57] ABSTRACT

A panic exit door locking mechanism in which a manually operable panic exit actuator device is mountable on the inside face of a hinged door having a tubular narrow stile frame along its swinging edge; top and bottom adjustable bolt mechanisms at the upper and lower ends of the frame are connected by length-adjustable rod structures, concealed in the narrow stile frame, with a pair of gear connected actuating levers that are operable by means of a drive shaft having a slip-joint connection with an actuating shaft of the panic exit device. The top bolt mechanism includes a keeper secured to an exposed wall of a door frame header by screw actuated inner and outer clamping members. A latching member carried by the door is movable into a keeper latching position when the door is closed, and to a keeper non-latching position when the door is opened. The top bolt is utilized to dog the latch in its keeper latching position.

18 Claims, 12 Drawing Figures

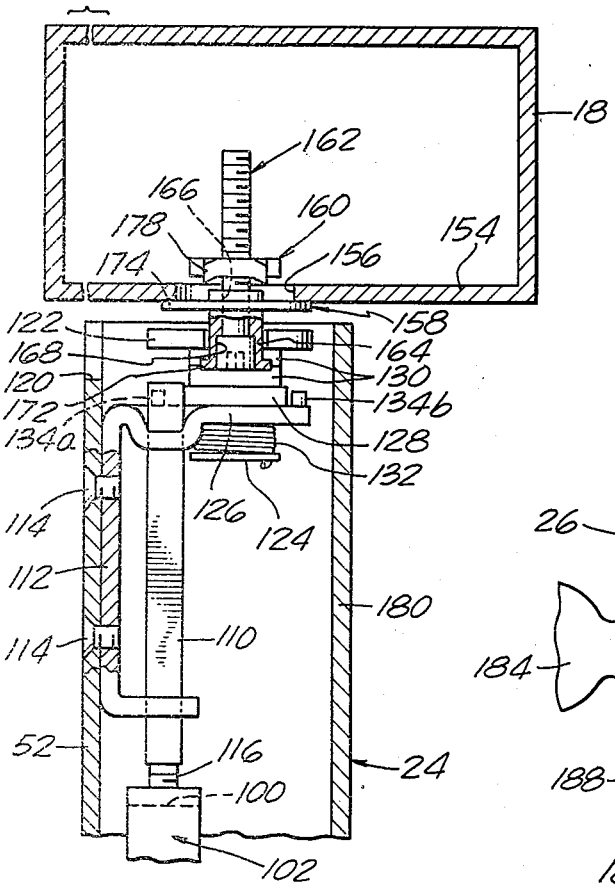
FIG. 6.
FIG. 5.
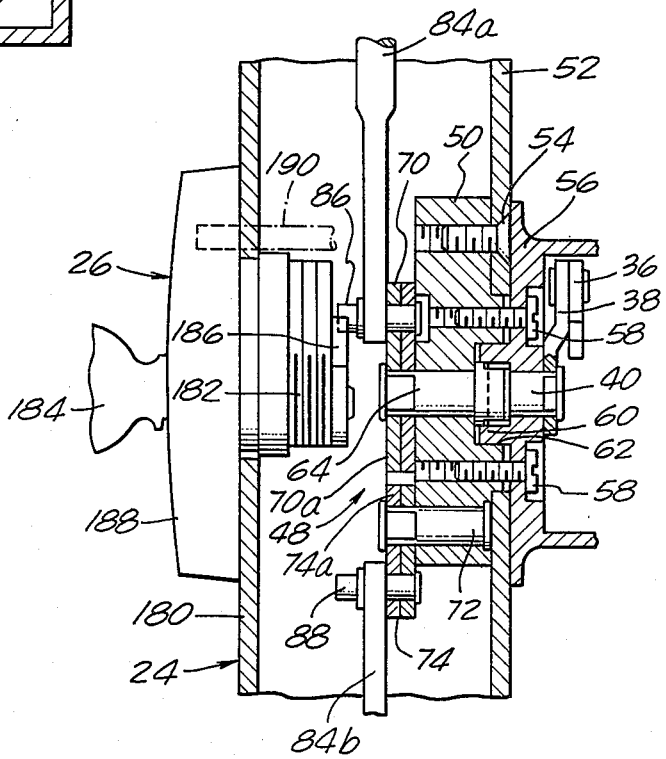
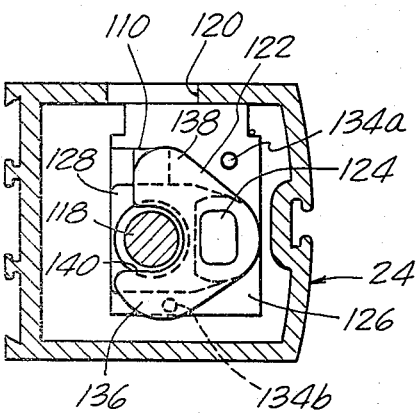
FIG. 7.
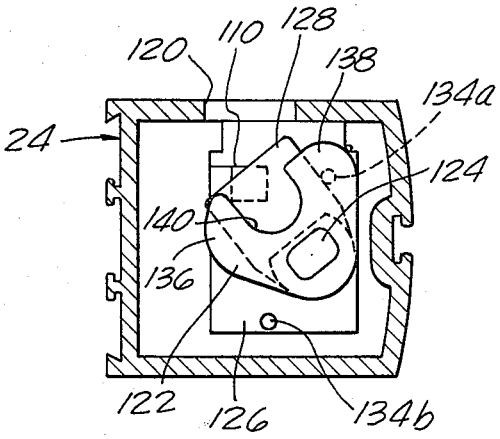
FIG. 8.

EXIT DOOR LOCKING MECHANISM HAVING MULTIPLE BOLTS

BACKGROUND OF THE INVENTION

The present invention relates generally to the field of safety exit doors, and locking machanism therefor.

More specifically, the present invention is in general similar to the exit door locking mechanism concept with multiple bolts as disclosed in the Brkic U.S. Pat. No. 4,130,306, issued Dec. 19, 1978, and which is incorporated herein by reference.

In the above noted patent, a panic exit actuator device of the push-bar type, as disclosed in U.S. Pat. No. 4,083,590, issued Apr. 11, 1978, is mounted on the inside of an emergency exit door and connected to rotate a common drive shaft for actuating a locking mechanism concealed in a narrow stile door frame which extends along the swinging edge of the door. The common drive shaft was permanently connected to operate a pair of interconnected levers respectively connected by rod structures with top and bottom bolt mechanisms, and wherein the top bolt mechanism includes a fixed member on the door frame header and a horizontally swingable latch member on the door arranged for engagement with and movement by the fixed member to a latching position when the door is in closed position, and swinging movement to an unlatched or released position when the door is opened. A dogging lever connected with the top bolt mechanism actuating rod structure serves to releasably dog the swingable latch member in its latching position.

The present invention incorporates a number of improved design and operating features which distinguish this invention over that disclosed in the above noted Patent, such features including the following:

1. One important feature resides in the incorporation of a slip-joint connection in the common drive shaft which connects the exit actuator device with the multiple bolt actuating mechanism in the new arrangement, whereby the panic exit actuator device and the multiple bolt actuating mechanism essentially become independent and separately mounted assemblies which are easily operatively connectable for combined coaction in a single installation. Installation and servicing are thus greatly facilitated.
2. Unique means of improved and new design provide for initial length adjustments of the bolt actuating rod structures, and for thereafter permanently securing the components of the rod structures in their adjusted positions.
3. The rod actuating levers have been interconnected in a different manner to obtain unitary actuation. For this purpose, the levers are formed with integral sector gear portions which provide improved operating characteristics.
4. The latching arrangement of the top bolt mechanism has been redesigned and modified to that the top bolt now functions as a dogging member for the latching member in its latching position.
5. The keeper assembly has been redesigned and modified to permit its being releasably mounted on an exposed door header frame wall by means of unique screw actuated clamping elements.

SUMMARY OF THE INVENTION

The present invention is more specifically concerned with improvements in locking mechanisms for panic exit doors with multiple bolt arrangements, and in particular with respect to the bolt mechanisms and the interconnections between the multiple bolt mechanisms and the panic exit actuator device mounted on the inside of the door.

It is one object of the present invention to provide improved connection means between a panic exit actuator device, mounted on the inside of an exit door, and a multiple bolt actuating mechanism, and which includes a separable slip-joint connection permitting independent installation and servicing of the panic exit actuator device and the multiple bolt actuating mechanism.

A further object is to provide a panic exit door actuator device of the multiple bolt type, in which the bolt mechanisms are operable by means of rod structures arranged to be initially adjusted to a predetermined length, depending upon the height of the door installation, and which includes means for permanently securing the components of the rod structures in their adjusted positions.

A further object is concerned with the provision of an improved arrangement in which the multiple bolts are actuated by a pair of drivingly interconnected actuating levers, the levers being integrally formed with sector gear portions having operative meshed relation.

Another object is to provide an improved top bolt mechanism for an exit door in which a swingable member is operatively engageable with a keeper mounted on the door frame header, the latching mechanism being movable by the keeper to a latching position when the door is closed, and to a non-latching position when the door is opened, and wherein a top bolt is utilized for dogging the latching member in its latching position.

Still another object is to provide a keeper assembly construction which is susceptible of mounting on an exposed wall of a door header frame, and which includes unique screw actuated clamping means, portions of which are insertable into a wall engaging position through an opening in the header wall.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings which are for illustrative purposes only;

FIG. 5 is a fragmentary vertical sectional view taken substantially on line 5—5 of FIG. 4*b*, to show details of the slip-joint driving connection between the panic actuator device and the multiple bolt actuating levers;

FIG. 6 is a fragmentary vertical sectional view taken substantially on line 6—6 of FIG. 4*a*, showing details of the top bolt mechanism, and means for mounting the keeper on the door frame header wall;

FIG. 7 is a transverse sectional view taken substantially on line 7—7 of FIG. 4*a*, and showing the latching member in a latching position with the keeper, and the top bolt in its dogging position;

FIG. 8 is a similar view to that of FIG. 7, except that the latching member is shown in its non-latching position;

DESCRIPTION OF THE DISCLOSED EMBODIMENT

Figure 1:
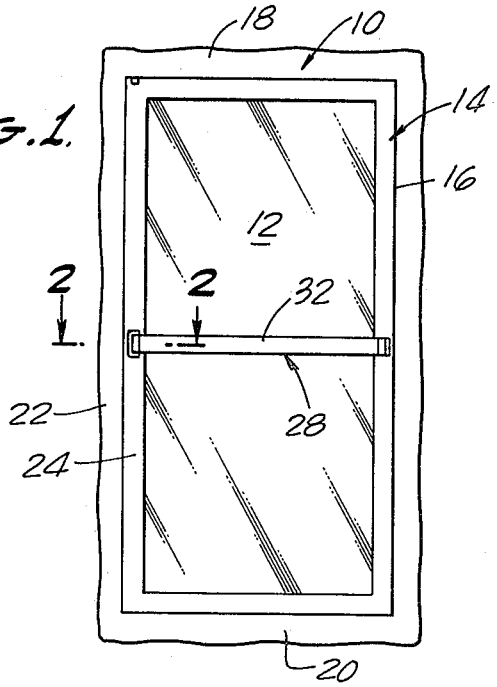
FIG. 1 is an inside elevational view of an exit door with a locking mechanism having multiple bolts according to the present invention, and including a panic actuator device mounted on the inside of the door.

For illustrative purposes, there is disclosed in FIG. 1 an exit door, as generally indicated by the numeral 10, of conventional construction in which a glass panel 12 is shown as being mounted within a surrounding narrow stile tubular frame 14. The door is conventionally hinged at its inner edge 16 for swinging movement within a door opening having a top header 18, bottom threshold 20, and in this case a door frame 22 that extends along the tubular frame 24 at the swinging edge of the door. Only one exit door has been shown in this case, but it is to be understood that the door opening may be of a size to operatively receive a pair of swinging doors having their swinging edges adjacently disposed. The door embodies a multiple bolt type actuating mechanism according to the present invention, which is arranged for selective operation by means of key-controlled means 26, shown as being mounted on the outside of the tubular frame 24 (FIG. 2) or by a panic exit actuator device, as generally indicated by the numeral 28, mounted on the inside of the door in spanning relation to extend between the door frame members at the hinged and swinging edges thereof.

Figure 3:
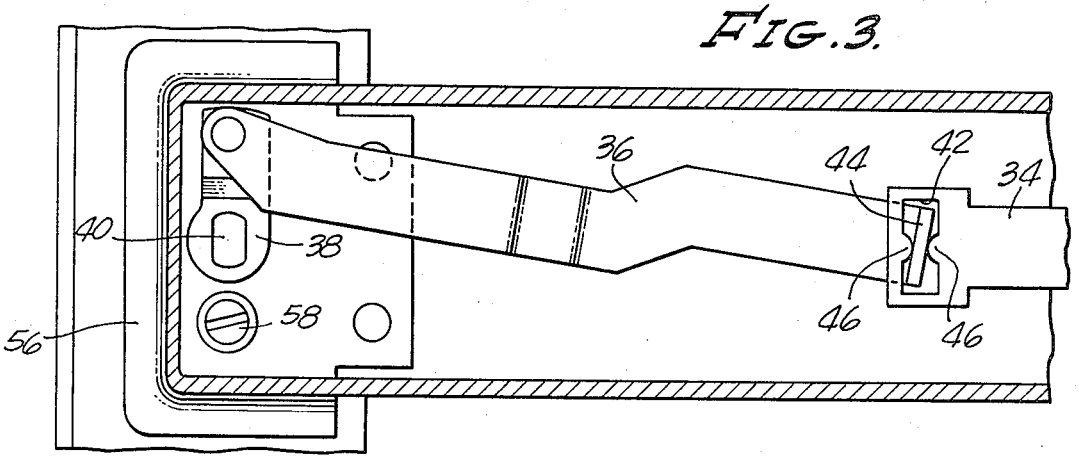
FIG. 3 is an enlarged fragmentary vertical view taken substantially on line 3—3 of FIG. 2, showing the actuating connection with the linkage system of the associated panic actuator device.

The panic exit actuator device 28 may be of any conventional construction, but preferably should mechanically be so designed as to deliver a rotary movement to an actuating shaft for the multiple bolt actuating mechanism. For illustrative purposes, the panic exit actuator device 28 basically conforms to that which is disclosed in the commonly owned U.S. Pat. No. 4,083,590, issued Apr. 11, 1978, which is incorporated herein by reference, and basically includes an elongate housing structure 30 and a coextensive exposed push-bar 32 which is supported for movement towards and away from the housing. The push-bar is connected to a connecting linkage (not shown) with a reciprocably mounted actuator element 34 such that when the push-bar is depressed the actuator element 34 will be moved towards the right, as viewed in FIG. 3. Spring means (not shown) normally urges the actuator element towards the left to a position as shown in FIG. 3. Reciprocable movements of the actuator element 34 are transmitted to an elongate connecting link 36 which is pivotally connected at one end with the outer end of a crank arm 38 affixed to and rotatable with an actuating shaft 40, this shaft being rotatably supported for rotation in an end portion of the housing structure 30. The other end of the connecting link 36 has a releasable connection with the actuator element 34. More specifically, as shown in FIG. 3, the adjacent end of the actuator element 34 is formed to provide a generally rectangular opening 42 which is adapted to receive endwise therein a right-angled end portion 44. This end portion is disposed between a pair of aligned abutment projections 46 extending from the opposite side edges of the rectangular opening 42, and upon which the end portion 44 is adapted to rock during reciprocable movements of the actuator element.

Figure 2:
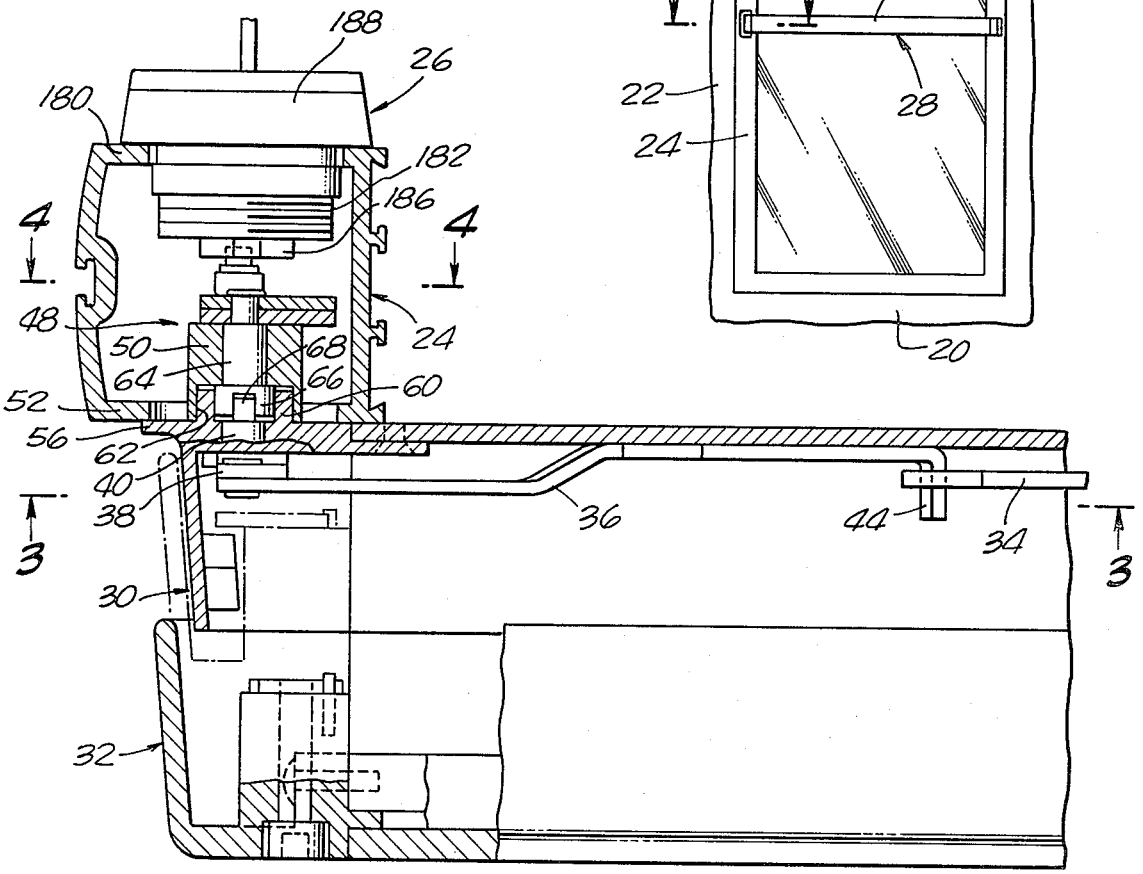
FIG. 2 is an enlarged fragmentary horizontal section of an end portion of a panic actuator device and associated key-controlled actuator device for selectively operating the multiple bolts, taken substantially on line 2—2 of FIG. 1.

An important feature of the present invention is that the multiple bolt actuating mechanism, as generally indicated by the numeral 48, and as best shown in FIGS. 2 and 5, comprises an independent and separately mountable assembly which is easily operatively connectable with the panic exit actuator device for combined coaction in a single installation.

As will more specifically appear, the multiple bolt actuating mechanism comprises a mounting bracket 50 which is mounted within the tubular stile frame member 24 and secured to its inner side wall 52 by means of a mounting screw 54. The mounting bracket 50 is also releasably interconnected to an adjacent end cap 56, which forms a part of the housing structure for the panic exit actuator device, by means of mounting screws 58. The body structures of the mounting bracket and the end cap are physically interconnected to telescoping portions which comprise an annular projection 60 of generally square configuration which is adapted to be inserted endwise into a recess 62 of square configuration formed in the facing surface of the mounting bracket 50.

As shown in FIG. 5, the mounting bracket 50 provides a bearing support for a drive shaft 64 which, in the interconnected relationship of the mounting bracket 50 and the end cap 56, will be in end-to-end axial alignment with the actuating shaft 40 which is rotatably supported in the end cap 56. As shown in FIG. 2, the adjacent ends of the actuating shaft 40 and the drive shaft 64 are formed with overlapping end portions 66 and 68 which coact to connect the shafts for unitary rotation, but which may be easily disengaged by axial separation when the mounting bracket 50 and end cap 56 are disconnected with respect to each other. The inner end of the drive shaft 64 fixedly mounts a lever arm 70.

The mounting bracket 50 also provides a bearing support for another rotatable shaft 72 which is positioned immediately below and in spaced relation to the shaft 64, the shaft 72 fixedly mounting a lever arm 74 at its inner end. The lever arms 70 and 74 provide rotatable lever means for the actuation of a top bolt mechanism, as generally indicated by the numeral 76 in FIG. 4*a*, and a bottom bolt mechanism as generally indicated by the numeral 78 in FIG. 4*c*, these bolt mechanisms being respectively connected with the lever means by an upper rod structure 80 and a lower rod section 84*a* which is connected by a pivot pin 86 with the outer end of the lever arm 70, and the lower rod structure 82 has an upper rod section 84*b* which is connected by a pivot pin 88 with the outer end of the lever arm 74. As shown in FIG. 4*b*, it will be noted that the affective operative length of the lever arm 70 is slightly greater than that of lever arm 74, and that when the rod structures 80 and 82 are moved apart to their separation limits, the pivot pins 86 and 88 will have assumed over-center positions with respect to the rotative axes of the drive shaft 64 and the rotatable shaft 72. The lever arm 70 and the lever arm 74 are interconnected for synchronized movement, and for this purpose the lever arms are fabricated to provide integrally formed sector gear portions 70*a* and 74*a* respectively, and which are in operative meshed relation. It has been found that operating advantages are obtained, if the pitch diameter of the sector gear 70*a* is made greater than that of the sector gear 74*a*.

Figure 4A:
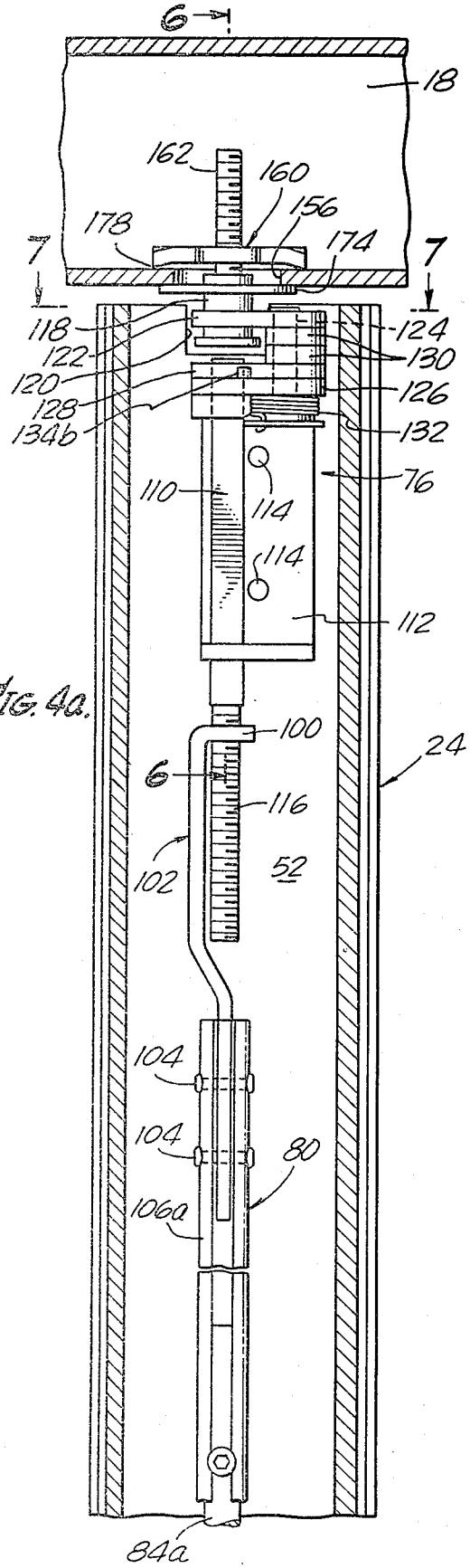
FIGS. 4*a*, 4*b* and 4*c* are transverse sectional views respectively showing the top bolt mechanism, the actuating lever assembly and the bottom bolt mechanism as contained within the tubular frame stile at the swinging edge of the door, the sectional views being taken substantially on line 4—4 of FIG. 2.
Figure 4B:
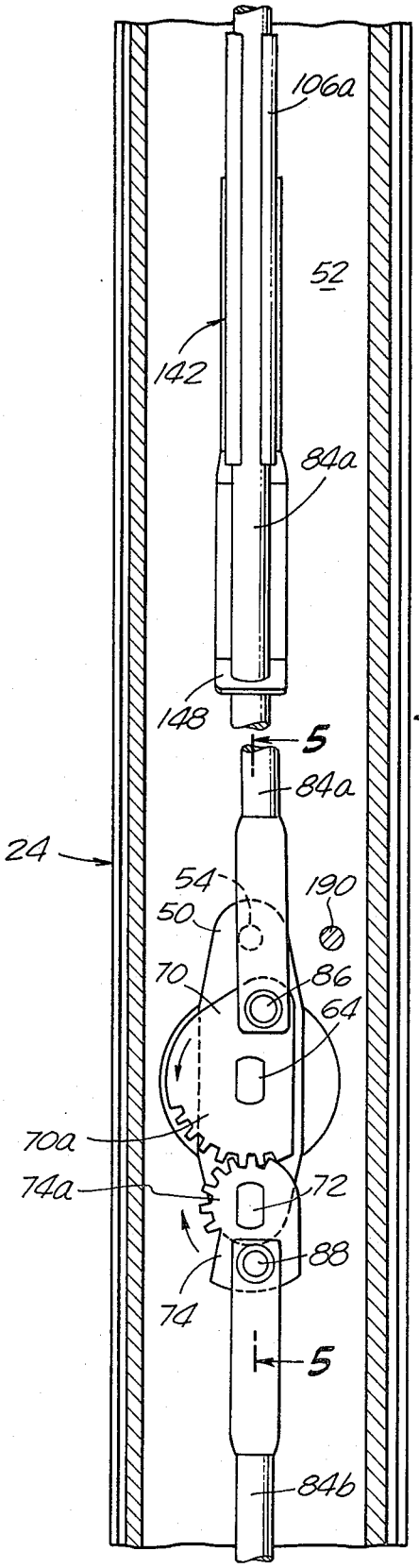
Figure 4C:
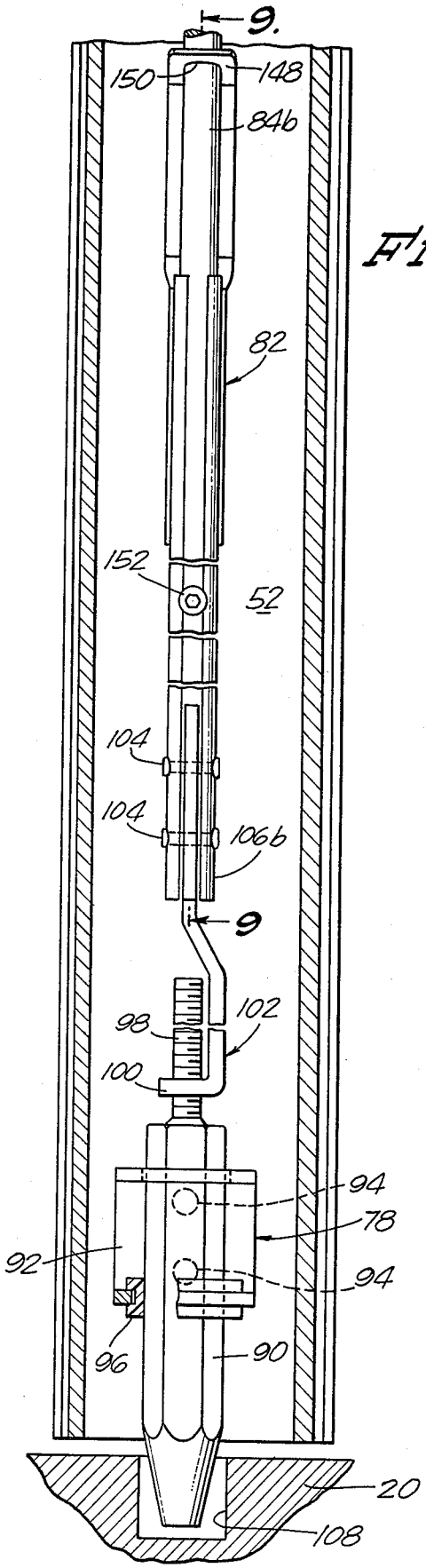

As best shown in FIG. 4*c*, the bottom bolt mechanism 78 comprises a bolt 90 formed from a hexagonal extrusion. This bolt is guidingly supported for vertical reciprocal movements in a U-shaped bracket 92 which is secured as by vertically aligned screws 94 to the inner side wall 52. Preferably, the bolt 90 is supported in a bracket arm by a suitable bushing 96 of nylon or other suitable material. The bolt 90 is formed with a threaded shank portion 98 having threaded adjusting engagement with a right-angled end portion 100 of an L-shaped bracket 102, the other end of which is secured by rivets 104 to the lowermost end of a longitudinally split tubular rod section 106*b* having telescopic connection with the rod section 84*b* which permits axial length adjustment of the lower rod structure 82 to accommodate the locking mechanism for doors of different height dimensions. The lowermost end of the bolt 90 is beveled, and arranged in the bolt extended position to seat within a keeper recess 108 formed in the bottom threshold 20.

The top bolt mechanism 76, as best shown in FIGS. 4*a* and 6, comprises a bolt 110 which is preferably of rectangular cross section. This bolt is guiding supported for vertical reciprocal movements in a U-shaped bracket 112 which is secured as by screws 114 to the inner side wall 52. In a similar manner to that described for the bolt 90, the bolt 110 is provided with a threaded shank portion 116 having threaded engagement with a similar L-shaped bracket 102 that is in this case connected by rivets 104 to the uppermost end of a longitudinally split tubular rod section 106*a*, which is similar to the rod section 106*b* as previously described, and which is connected in telescopic adjustable relation with the lower rod section 84*a* of the upper rod structure 80.

The top bolt mechanism further includes a fixed keeper 118 which is secured to the top frame header 18 of the door in a manner which will be described subsequently in detail. This keeper projects downwardly from the door header into the path of travel of the upper end of the tubular frame member 24, a notch 120 being provided at the upper end of the inner side wall 52 to permit passage of the keeper into the frame member as the door moves into a closed position.

Latching means are provided for operative association with the keeper 118 in the closed position of the door, and comprises a latching member 122 which is mounted upon the upper end of a shaft 124 that is rotatably supported in an upper leg 126 of the bracket 112. The latching member is positioned in spaced relation to an adjacent dogging plate 128 by means of spacer elements 130. As thus arranged, the latching member and dogging plate are affixed to the shaft 124 and are normally urged in planes of rotation in right angled relation to the longitudinal axis of movement of the bolt 110 by coil spring 132 towards a non-latched position, as shown in FIG. 8, in which the dogging plate engages a stop pin 134*a*. As will be seen, the latching member is formed with radially diverging fingers 136 and 138 which coact to define an end opening slot 140 which, in the non-latched position of the latching member, faces the notch 120 for receiving the keeper therein as the door is moved to closed position. During this movement, the keeper will act to rotate the latching member 122 into a latched position as shown in FIG. 7, in which the dogging plate 128 will be slightly spaced from a limiting stop pin 134*b*. In such position, it will be seen that the top bolt 110 will now be free to move upwardly into a dogging position with respect to the dogging plate 128 and thus prevent movement of the door to an open position until such time as the bolts 90 and 110 are withdrawn either by the actuation of the panic exit actuator device 28 or the key-control means 26, when utilized. It will also be apparent that when the bolts 90 and 110 have been retracted, movement of the dogging plate 128 to the position shown in FIG. 8 will serve to dog these bolts in their retracted positions, until such time as the door is closed and the latching member 122 moved to its latched position as shown in FIG. 7.

Figure 9:
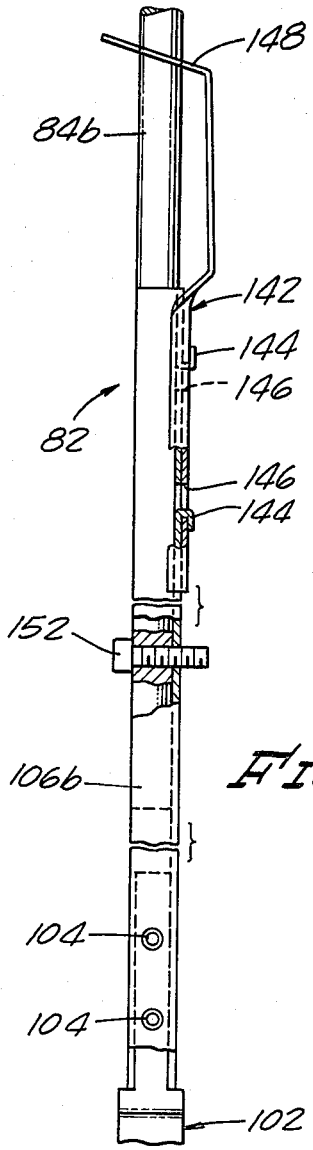
FIG. 9 is a fragmentary elevational view showing details of the connecting rod structure, and the means for initial and permanent connection of its link adjusting components.

As previously mentioned, the rod structures 80 and 82 are telescopically axially adjustable in order to vary their length and accommodate the multiple bolt actuating mechanism for doors of different height. As shown in FIG. 9, similar means are provided for releasably retaining each of the connecting rod structures in their adjusted telescopic relation. For example, in the case of the lower rod structure 82, an elongate spring member 142 is anchored at one end by a pair of upset retaining fingers 144 provided on the split tubular rod section 106*b* and adopted to extend through spaced openings 146 provided on the spring member. The other end of this spring is deflected to define an angularly extending portion 148 which contains an opening 150 for the passage of the rod section 84*b*. Normally, the spring action causes the portion 148 to grip the associated rod section 84*b*, but upon deflection of the spring enables relative axial movement between the rod sections 84*b* and 106*b*. Upon release of the spring, the spring will retain these sections in their adjusted position.

However, in order to assure that the adjusted positions are retained, provision is made for permanently interconnecting the sections 84*b* and 86*b* in order to prevent axial telescoping movement therebetween. For this purpose, a screw 152 is mounted in a transversely extending threaded bore of the rod section 84*b*. Upon tightening, this screw will be forced through the adjacent wall of the associated tubular rod section 106*b* so as to permanently bind and retain the rod sections against axial movement. Even without the connection afforded by the screws 152, the telescoping rod structure arrangement provides a fail safe feature in that any debris obstruction or the like which might prevent or oppose movement of the bolt 90 or bolt 110 to a bolt operated position would tend to shorten the rod structures and thus prevent the bolts from inadvertently becoming seated in their bolt operative position.

Figure 10:
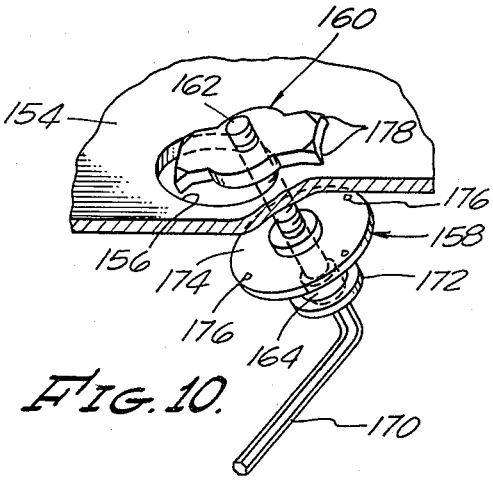
FIG. 10 is a perspective view showing details of the keeper assembly and the manner of mounting on a header frame wall.

Having reference to FIGS. 6 and 10, the details of the fixed keeper 118 assembly are shown with its respective components which are of particular advantage for mounting the keeper, for example, on an exposed wall 154 of a top header 18, where such header comprises a metalic tubular frame member.

In its broad aspects the keeper assembly is arranged to be mounted through an opening 156 in the wall 154, and comprises a pair of clamping members 158 and 160 which are operably moved into clamped engagement with the outer and inner surfaces of the wall 154 by means of an actuating screw 162.

More specifically, the clamping member 158 is constructed to provide an elongate tubular body portion 164 having an axially extending bore for slidably surrounding the threads on the screw 162. A counterbore 168 seatingly receives the head portion of the screw 162, this head portion being adapted to receive a screw actuating tool 170, when mounting the keeper on the door header. The tubular body 164 is formed at one end with a small radial flange 172, and at its other end with a relatively larger radial flange 174 which is of a diameter such that it wil cover the opening 156, when the keeper is assembled in its operative position on the header. The flange 174 carries a plurality of pointed surface projections 176 for non-slip engagement with the adjacent surface of the header wall.

The clamping member 160 is of elongate bar configuration and has a threaded opening intermediate its ends for operative engagement with the threads of the screw 162. The bar is of a length sufficient to bridge the opening 156, and is provided at its ends with upset pointed corner projections 178 for making non-slip engagement with the adjacent surface of the wall, when the keeper is mounted thereon.

In order to facilitate the mounting of the keeper on the wall 154 of the header, the screw 162 is of sufficient length to permit movement of the clamping members 158 and 160 into spaced apart relation, as shown in FIG. 10, to permit sufficient tilting of the clamping member 160 to enable its passage through the opening 156 to the interior of the header. It is then a simple matter to tighten the screw 162 so as to fixedly secure the keeper in its operative position on the header.

The key-controlled means 26 is shown in FIG. 5 as being mounted on an outer side wall 180 of the tubular frame member 24, to provide an authorized actuator on the outer side of the door to permit the locking mechanism to be unlocked, when desired, from the outside. As shown, the key-controlled means is of conventional construction and comprises a tumbler lock cylinder 182 adapted for actuation by means of a suitable key 184 to rotate an operably associated cam lever 186 into engagement with an end of the pivot pin 86, and thereby rotate the lever arms 70 and 74 in the appropriate direction to unlock the top and bottom bolt mechanism. The cam lever 186 has lost motion relation with respect to the pin 86. If desired, the key-controlled means may be mounted so that the cam lever 186 engages pin 88 instead of pin 86.

As will be seen, the tumbler lock cylinder is mounted on an exterior mounting plate 188 (FIG. 5), this plate being secured in position by a mounting screw 190 which extends between the side walls 52 and 180 of the tubular frame 24.

From the foregoing description and drawings, it will be clearly evident that the delineated objects and features of the invention will be accomplished.

Various modifications may suggest themselves to those skilled in the art without departing from the spirit of my invention, and hence, I do not wish to be restricted to the specific forms shown or uses mentioned, except to the extent indicated in the appended claims.

I claim:

1. A lock mechanism for an exit door having a tubular stile frame member extending along its swinging edge, and with top and bottom bolt mechanism, comprising:

(a) lever means positioned in the tubular stile, including a pair of separate rotatably mounted levers;

(b) rod structures in the stile respectively connecting said levers with the top and bottom bolt mechanisms, the top bolt mechanism including a fixed keeper member on a top header frame and a horizontally swingable latch member mounted on the door to be engaged with said keeper member when the door is in a closed position, said latch member being swingable into a released position with respect to said keeper member to permit the door to be opened;

(c) a driving connection between said levers;

(d) a rotatable driver shaft mounting one of said levers;

(e) said lever means being normally operative by said driver shaft in one direction to axially move said rod structures away from each other to effect one operating condition of the bolt mechanisms; and (f) manually operable means accessible from the inner side of the door for rotating said levers by said drive shaft in an opposite direction to axially move said rod structures towards each other to effect another operating condition of the bolt mechanisms, including a rotatably mounted actuating shaft releasably connectable in axial alignment with said driver shaft.

2. A lock mechanism as set forth in claim 1, in which:

the driving connection between said levers comprises toothed gear means, whereby the levers are simultaneously rotated in opposite directions.

3. A lock mechanism as set forth in claim 1, in which:

said one of said levers has a greater operative length than the other of said levers.

4. A lock mechanism as set forth in claim 1, in which:

said levers are operatively interconnected by intermeshing toothed sector gear portions respectively formed on said levers; and the pitch diameter of the sector gear portion of said one lever is greater than the pitch diameter of the sector gear portion of the other of said levers.

5. A lock mechanism as set forth in claim 1, in which:

the manually operable means includes a depressable push-bar connected with said actuating shaft and being operative when pushed to rotate said actuating shaft; and the releasable connection between the driver shaft and the actuating shaft comprises overlapping end portions of the shafts which are adapted to be desengaged by axial separation of the joined shaft ends.

6. A lock mechanism as set forth in claim 1, in which:

the manually operable means includes a depressable push-bar connected with a reciprocable actuator element having an end fabricated to provide a generally rectangular opening;

a crank arm is carried by said actuator shaft;

a link member, connected with said crank arm, is releasably connected with the reciprocable actuator element by means of a right angled end portion adapted to extend through said rectangular opening; and said opening defines opposed aligned abutment projections on opposite sides of said end portion and upon which it is adapted to rock during reciprocable movements of the actuator element.

7. A lock mechanism as set forth in claim 1, in which:

the bolt of the top bolt mechanism is movable longitudinally into a dogging position in the closed position of the door by upward movement of its connected rod structure to oppose swinging movement of the latch member into said released position.

8. A lock mechanism as set forth in claim 7, in which:

a dogging plate is connected for swinging movement with said latch member, to latch dogging and latch non-dogging positions;

the bolt is supported for axial movements in right angle relation to the plane of swinging movement of said dogging plate; and movement of said bolt to its dogging position opposes movement of said dogging plate from its latch dogging position to its latch non-dogging position.

9. A lock mechanism as set forth in claim 1, in which:

the top header comprises an extended wall having an opening therein; and the fixed keeper member extends through said opening and is supported in operative position by mounting clamping elements respectively engageable with inner and outer surfaces of said wall.

10. A lock mechanism as set forth in claim 9, in which:

actuating means is rotatably supported in one of said clamping elements and operable for moving said elements to clamped and nonclamped positions, said actuating means being accessible and operable from the wall exterior.

11. A lock mechanism as set forth in claim 10, in which:

the outer clamping element is integrally formed with said fixed keeper member and is of a size such that, in its clamped position, it will close said opening.

12. A lock mechanism as set forth in claim 10, in which:

the inner clamping element threadedly engages said actuating means and in its clamped position spans the opening.

13. A lock mechanism as set forth in claim 10, in which:

the clamping elements are respectively formed to provide pointed projection for non-slip engagement with the associated wall surfaces.

14. A lock mechanism as set forth in claim 10, in which the inner clamping element comprises:

an elongate bar having a threaded opening intermediate its ends for threaded engagement with said actuating means; and upset end corners providing pointed projections for non-slip engagement with an adjacent surface of said wall.

15. A lock mechanism as set forth in claim 10, in which the fixed keeper and outer clamping element comprises:

an elongate tubular portion having an axially extending bore terminating at one end in a counterbore;

an outwardly extending annular radial flange at said one end; and an outwardly extending annular radial flange of relatively greater diameter at the other end of said bore formed with peripheral pointed projections for engaging an adjacent surface of said wall.

16. A lock mechanism for an exit door having a tubular stile frame member extending along its swinging edge, and with top and bottom bolt mechanisms, comprising:

(a) lever means positioned in the tubular stile, including a pair of separate rotatably mounted levers;

(b) rod structures in the stile respectively connecting said levers with the top and bottom bolt mechanisms, each of which includes a bolt mounted for reciprocable endwise adjusting movement, and each rod structure comprises:

an elongate rod member and an elongate longitudinally split tubular member having adjacent ends in axially adjustable telescoping relation to form a slip joint;

means for releasably retaining said ends in the adjusted telescoping relation for unitary movements including an elongate spring having one end fixedly secured to the adjacent end of the tubular member, and a projecting flat portion having an angularly deflected outer end portion formed with an opening for receiving the associated rod member endwise therethrough, said deflected end portion being normally resiliently urged into gripped relation with the rod member but being manually deflectable into released relationship to enable adjusting movements between the rod member and tubular member;

(c) a driving connection between said levers;

(d) said lever means being normally operative in one direction to axially move said rod structures away from each other to effect one operating condition of the bolt mechanisms, and (e) manually operable means accessible from one side of the door for rotating one of said levers and the connected other lever of the levers as a unit in an opposite direction to axially move said rod structures towards each other to effect another operating condition of the bolt mechanisms.

17. A lock mechanism as set forth in claim 16, in which:

means are provided for fixedly securing the rod member and tubular member in an axially adjusted position, independently of said spring, comprising a screw extending through the longitudinal split of the tubular member and having threaded engagement with a transverse threaded bore in the rod member, whereby, upon a tightening actuation of the screw, the outer end of the screw will be forcibly pushed through the adjacent wall of the tubular member.

18. A lock mechanism according to claim 16, in which:

a generally L-shaped bracket adjustably supports said bolt, said bracket having a shank end adapted to be inserted endwise into the outer end of the tubular member, and a right angled outer end portion having a threaded bore for threadedly receiving a threaded portion of the bolt; and means connecting the inserted shank of the bracket and the outer end of the tubular member.

* * * * *